US008826874B2

(12) United States Patent
Hattiangadi et al.

(10) Patent No.: US 8,826,874 B2
(45) Date of Patent: Sep. 9, 2014

(54) ANTI-ROTATION ROLLER VALVE LIFTER

(75) Inventors: Ashwin A. Hattiangadi, Edwards, IL (US); Alin R. Olaru, Peoria, IL (US); Jonathan R. Chittenden, Edwards, IL (US); Philip C. Millward, Novi, MI (US)

(73) Assignee: Caterpillar Inc., Peoria, IL (US)

( * ) Notice: Subject to any disclaimer, the term of this patent is extended or adjusted under 35 U.S.C. 154(b) by 92 days.

(21) Appl. No.: 13/332,534

(22) Filed: Dec. 21, 2011

(65) Prior Publication Data

US 2012/0160195 A1 Jun. 28, 2012

Related U.S. Application Data

(60) Provisional application No. 61/426,171, filed on Dec. 22, 2010.

(51) Int. Cl.
*F01L 1/14* (2006.01)
*F01L 1/26* (2006.01)
*F01L 1/18* (2006.01)

(52) U.S. Cl.
CPC . *F01L 1/146* (2013.01); *F01L 1/26* (2013.01); *F01L 1/181* (2013.01)
USPC ..... 123/90.5

(58) Field of Classification Search
USPC ..... 123/90.5
See application file for complete search history.

(56) References Cited

U.S. PATENT DOCUMENTS

| | | | | |
|---|---|---|---|---|
| 1,500,865 | A * | 7/1924 | Foss | 123/90.49 |
| 2,207,324 | A | 7/1940 | L'Orange | |
| 2,935,878 | A | 5/1960 | Wirsching | |
| 3,668,945 | A | 6/1972 | Hofmann | |
| 4,326,484 | A | 4/1982 | Amrhein | |
| 4,448,155 | A * | 5/1984 | Hillebrand et al. | 123/90.5 |
| 4,637,357 | A | 1/1987 | Ohmi | |
| 4,809,651 | A * | 3/1989 | Gerchow et al. | 123/90.5 |
| 5,022,356 | A | 6/1991 | Morel, Jr. et al. | |
| 5,127,374 | A | 7/1992 | Morel, Jr. et al. | |
| 5,934,232 | A | 8/1999 | Greene et al. | |
| 6,209,498 | B1 | 4/2001 | Brothers | |
| 6,328,009 | B1 | 12/2001 | Brothers | |
| 6,691,658 | B2 | 2/2004 | Fujita et al. | |
| 6,978,752 | B2 | 12/2005 | Albertson et al. | |
| 7,409,940 | B2 | 8/2008 | Riley | |
| 7,431,001 | B2 * | 10/2008 | Keller et al. | 123/90.5 |
| 7,565,890 | B2 | 7/2009 | Keller et al. | |
| 2001/0004886 | A1 | 6/2001 | Brothers | |
| 2005/0098126 | A1 * | 5/2005 | Haas et al. | 123/90.5 |
| 2007/0119398 | A1 | 5/2007 | Riley | |
| 2007/0209623 | A1 | 9/2007 | Klotz | |

* cited by examiner

*Primary Examiner* — Thomas Denion
*Assistant Examiner* — Steven D Shipe

(57) ABSTRACT

A roller lifter for an internal combustion engine includes a cylindrical lifter body having a first end, a second end and a roller rotatably attached to the first end. The first end has a first diameter and the second end has a second diameter greater than the first diameter and a flat surface configured to engage a corresponding flat surface on an adjacent roller lifter and to prevent axial rotation of the roller lifter while in use. The roller lifter may further include a recess extending along a longitudinal axis from the second end toward the first end.

10 Claims, 4 Drawing Sheets

ANTI-ROTATION ROLLER VALVE LIFTER

TECHNICAL FIELD

This disclosure relates generally to roller lifters for an engine, and more specifically to a roller lifters with structure that prevents lifter rotation.

BACKGROUND

Many internal combustion engine use a combination of a camshaft, lifter, push rod, and rocker arm to operate the intake and exhaust valves of the engine. Generally, the lifter engages the lobe of the camshaft and reciprocates in a bore in response to camshaft rotation. In turn, the reciprocating movement of the lifter is transferred through the push rod and rocker arm to open and close of the valves. Some lifters may employ rollers at the interface with the cam lobe. In operation, the rollers rotate against the cam lobe thereby minimizing friction between the cam lobe and the lifter. For proper operation, the orientation of the roller lifters must be controlled so as to keep the axis of the roller parallel with the axis of the camshaft. Roller lifters, however, have a tendency to rotate within the lifter bore during engine operation and become misaligned, which may result in damage to the lifter and camshaft. For this reason, engines that employ roller valve lifters typically use some type of alignment device that prevents the roller lifters from rotating within the lifter bore.

Guide plates, such as the plate disclosed in U.S. Pat. No. 6,978,752 to Albertson et al., or inserts/clips, such as the member disclosed in U.S. Pat. No. 5,022,356, have been used in the past as alignment devices. These solutions, however, add additional components to the engine which increase cost and complexity, as well as adding the possibility of inadvertently omitting a component.

SUMMARY OF THE DISCLOSURE

According to certain aspects of this disclosure, an internal combustion engine includes an engine block forming a first lifter bore and a second lifter bore. A first roller lifter is received in the first lifter bore and a second roller lifter received in the second lifter bore. During operation of the engine, the first roller lifter engages the second roller lifter to prevent axial rotation of the first roller lifter and the second roller lifter. In one embodiment, the body of the first roller lifter includes a flat surface that engages a flat surface on the body of the second roller lifter.

In another aspect of the disclosure, a roller lifter for an internal combustion engine includes a cylindrical lifter body having a first end, a second end and a recess extending along a longitudinal axis from the second end toward the first end. A roller is rotatably attached to the first end. The first end has a first diameter and the second end has a second diameter greater than the first diameter. In one embodiment, the second end includes a flat surface configured to engage a corresponding flat surface on an adjacent roller lifter.

DETAILED DESCRIPTION

Figure 1:
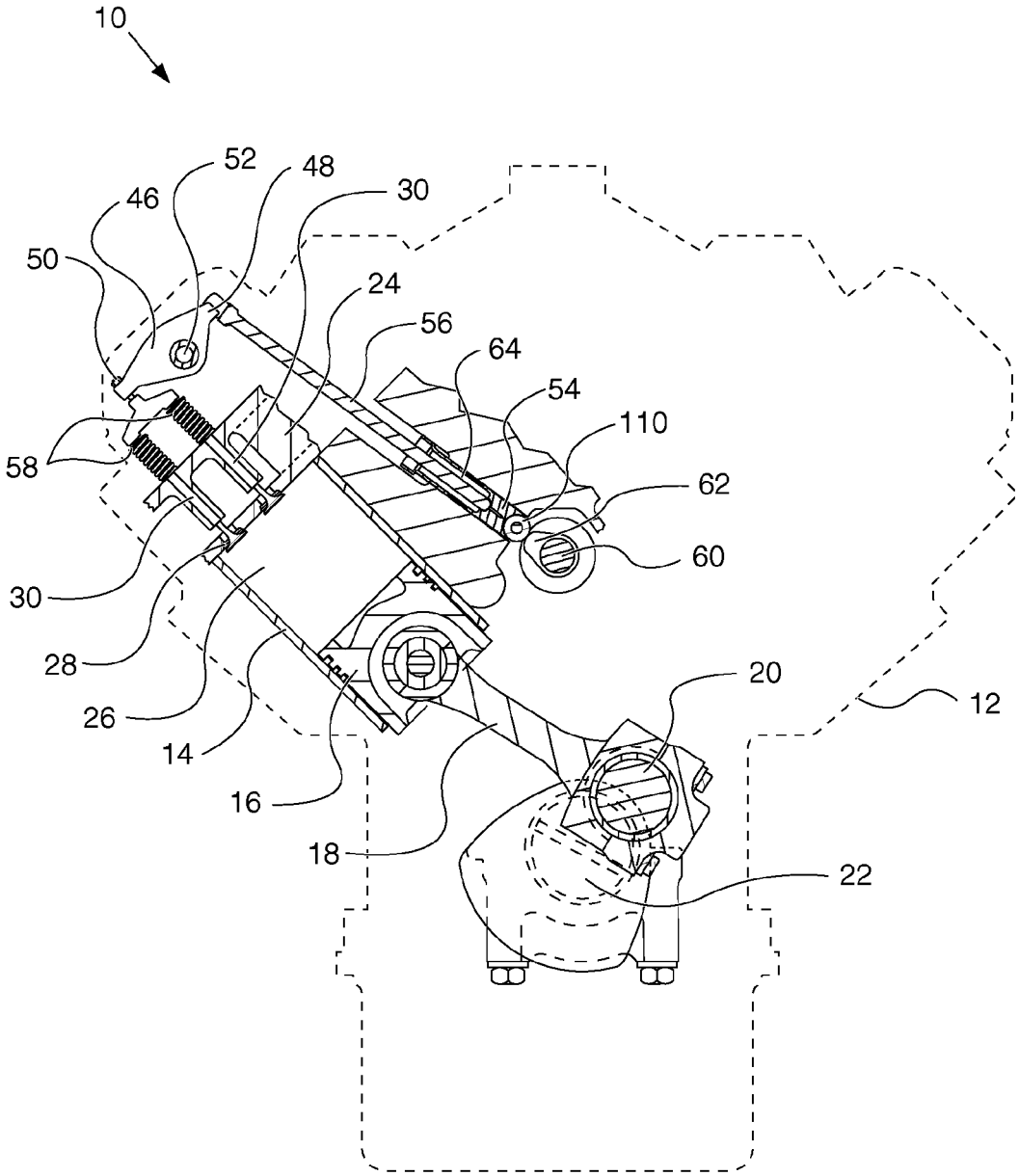
FIG. 1 is a partial cross-section of an internal combustion engine.

An exemplary embodiment of an engine 10 is illustrated in FIG. 1. For the purposes of the present disclosure, engine 10 is considered a four-stroke diesel engine. One skilled in the art will recognize, however, that engine 10 may be any other type of internal combustion engine such as, for example, a gasoline or natural gas engine.

Engine 10 includes an engine block 12 having a plurality of cylinders 14 (one of which is illustrated in FIG. 1). A piston 16 is slidably disposed within cylinder 14 to reciprocate between a top-dead-center position and a bottom-dead-center position. A connecting rod 18 connects piston 16 to an eccentric crankpin 20 of a crankshaft 22 such that reciprocating motion of the piston results in rotation of crankshaft 22.

Engine 10 also includes a cylinder head 24. Cylinder head 24 is engaged with engine block 12 to cover cylinder 14 and define a combustion chamber 26. Cylinder head 24 defines intake and exhaust openings 28 allow intake gases into combustion chamber 26 and exhaust gases out of the combustion chamber, respectively. Engine valves 30 are positioned to selectively open and close the openings. Each cylinder 14 may include multiple intake and exhaust openings 28.

Figure 2:
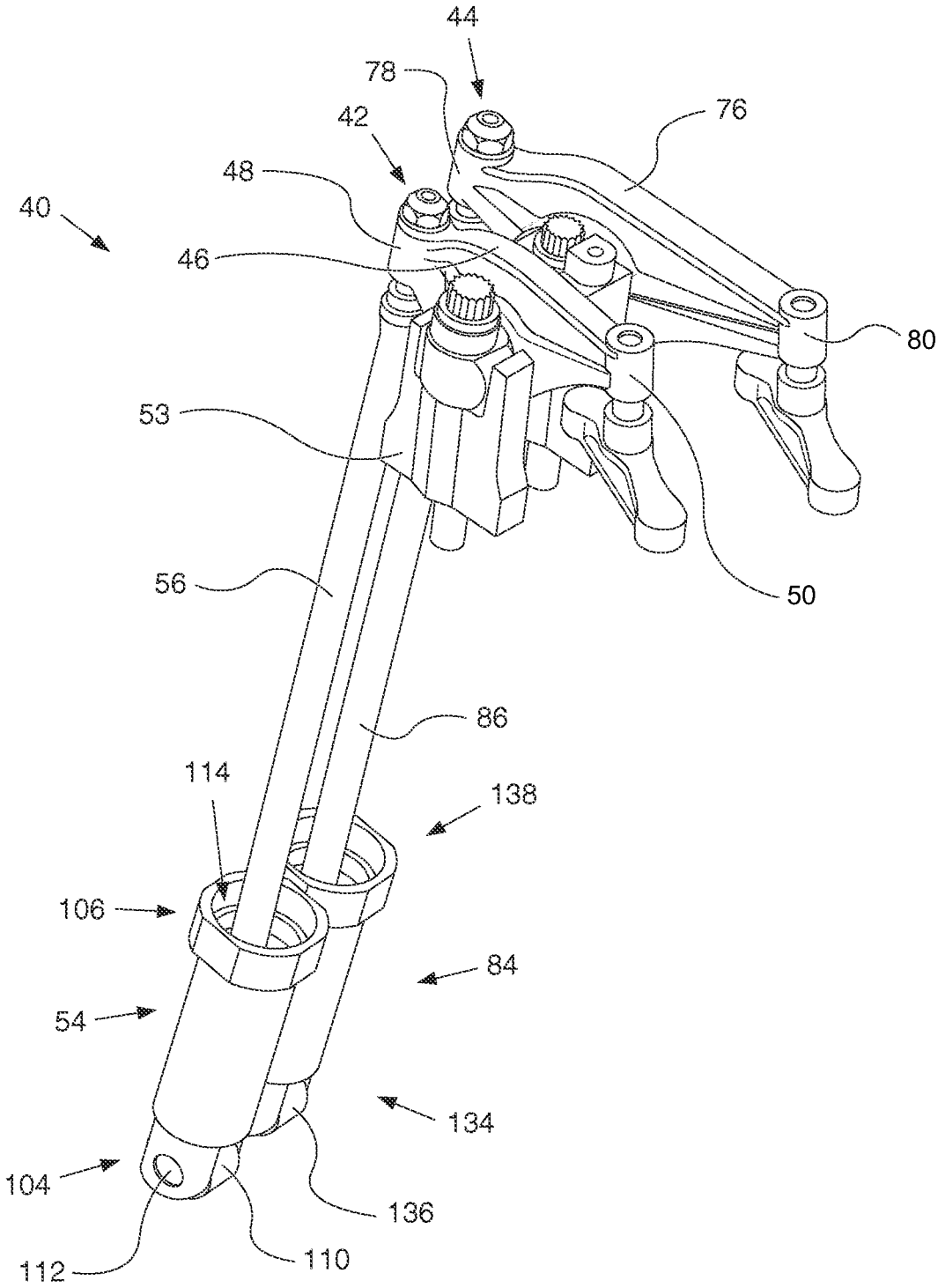
FIG. 2 is a perspective view two valve actuation assemblies of the engine of FIG. 1.

The engine may include a series of valve actuation assemblies 40 (one of which is illustrated in FIG. 1). Engine 10 may include two valve actuation assemblies 40 for each cylinder 14 (as shown in FIG. 2). A first valve actuation assembly 42 may be provided per cylinder to open and close the intake valves and a second valve actuation assembly 44 may be provided to open and close the exhaust valves. Alternatively, engine 10 may include a separate valve actuation assembly to actuate each intake valve and each exhaust valve.

The first valve actuation assembly 42 includes a first rocker arm 46 having a first end 48, a second end 50, and a pivot point 52. The first rocker arm 46 may be pivotally mounted on a stanchion 53 (See FIG. 2). First end 48 of first rocker arm 46 is operatively engaged with a first lifter 54 through a first push rod 56. Second end 50 of the first rocker arm 46 is operatively engaged with the intake valves 30. Oscillation of first rocker arm 46 about pivot point 52 causes the intake valves 30 to move between an open position and a close position. The first valve actuation assembly 42 may also include valve springs 58 that bias the valves 30 toward the closed position (i.e. closing the intake and exhaust openings 28).

The engine 10 also includes a camshaft 60 that operatively engages the crankshaft 22. The camshaft 60 may be connected with crankshaft 22 in any manner readily apparent to one skilled in the art where a rotation of crankshaft 22 will result in a corresponding rotation of camshaft 60. For example, camshaft 60 may be connected to crankshaft 22 through a gear train (not shown).

As shown in FIG. 1, a first cam lobe 62 may be disposed on camshaft 60 to engage the first lifter 54. One skilled in the art will recognize that camshaft 60 may include additional cam lobes to engage with other lifters in order to actuate additional engine valves. The first lifter 54 is disposed in a first lifter bore 64 formed by the engine block.

As shown in FIG. 2, the second valve actuation assembly 44 operates in a similar manner to the first valve actuation assembly 42 in that it includes a second rocker arm 76 having a first end 78 that is operatively engaged with a second lifter 84 through a push rod 86 and a second end 80 that is operatively engaged with exhaust valves (not shown). Similar to the first lifter 54, the second lifter 84 is disposed in a second lifter bore 88 (see FIG. 3) and engages a second cam lobe (not shown). The second lifter bore 88 is separated from the first lifter bore 64 by a wall 90.

Figure 3:
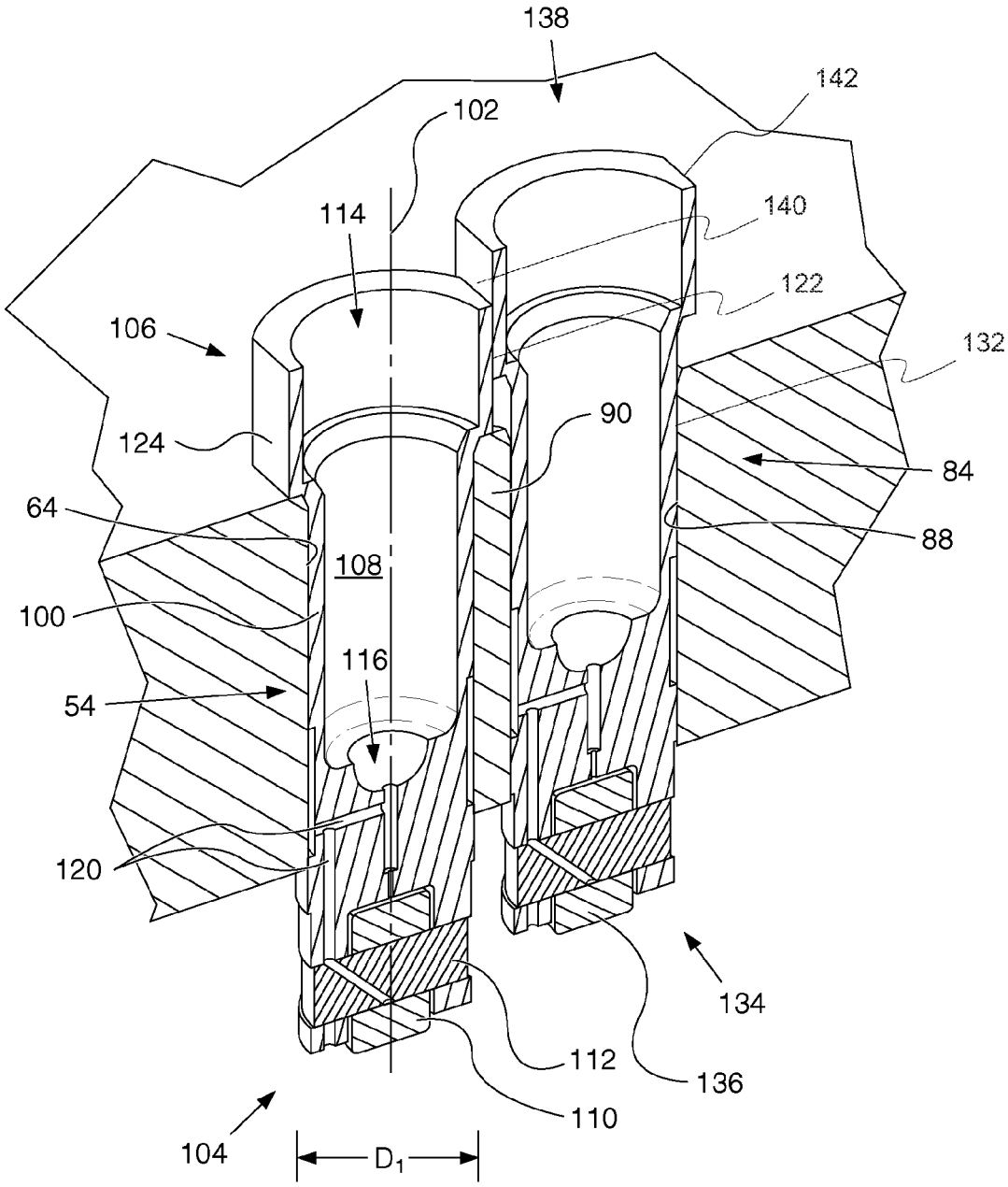
FIG. 3 is a partial cross sectional view of two lifters in lifter bores of the engine of FIG. 1.

Referring to FIG. 3, the first lifter 54 includes a first lifter body 100. The first lifter body 100 is generally cylindrical and extends along a first longitudinal axis 102. The first lifter body 100 has a first end 104, a second end 106, and defines a recess 108 that extends along the first longitudinal axis 102 from the second end 106 toward the first end 104. A roller 110 is rotatably attached to the first end 104 by a roller pin 112. A portion of the roller 110 extends beyond the first end 104 such that it may engage the first cam lobe 62.

The second end 106 forms an opening 114 to the recess 108. The recess 108 is configured to receive an end of the first push rod 56. In the depicted embodiment, the recess 108 extends along the first lifter 54 greater than half the total length of the first lifter 54. The first lifter body 100 forms a cup 116 at the terminal end of the recess 108. The cup 116 is configured to receive the terminal end of the first push rod 56.

The first lifter body 100 also defines one or more fluid passages 120. The fluid passages 120 are configured to direct lubricant, such as engine oil, to the exterior surface of the roller 110, to interface between the roller pin 112 and the interior surface of the roller (via a fluid passage in the roller pin), and to the interface between the exterior surface of the first lifter body 100 and the first lifter bore 64.

In many engine designs, roller lifters include a hydraulic lash adjustment mechanism. While the depicted embodiment of the first and second roller lifters 54, 84 does not include hydraulic lash adjustment mechanisms, it would be apparent to person of ordinary skill in the art that in other embodiments, hydraulic lash adjustment mechanisms may be incorporated in the lifter design.

The first end 104 of the first lifter 54 (and the majority of the first lifter body 100) has a first diameter $D_1$ that is slightly smaller than the diameter of the first lifter bore 64 such that the first lifter 54 may reciprocate freely within the first lifter bore. The first lifter body 100 also includes structure configured to prevent undesired rotation of the lifter. The structure may be configured in a variety of ways. Any structure capable of cooperating with corresponding structure on an adjacent lifter may be used. In the depicted embodiment, the second end 106 of the first lifter 54 has a second diameter $D_2$ (see FIG. 4) that is greater than the first diameter $D_1$ and greater than the diameter of the first lifter bore 64. Thus, the second end 106 does not fit within the first lifter bore 64 and remains external to the bore during operation of the engine 10.

Figure 4:
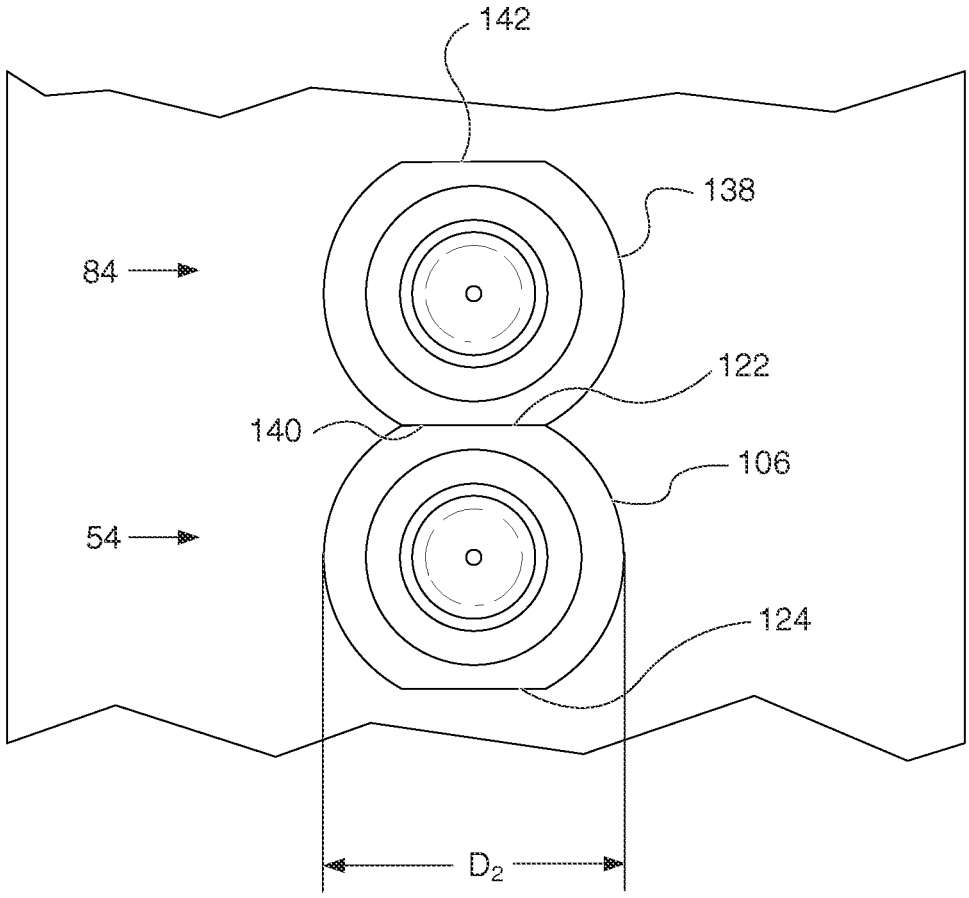
FIG. 4 is a top view of the lifters of FIG. 3.

The second end 106 includes a first flat surface 122 and a second flat surface 124 formed on the opposite side of the second end 106 from the first flat surface 122. In other embodiments, however, the second end may include more or less than two flat surfaces. As illustrated in FIG. 4, the first flat surface 122 and the second flat surface 124 form chords on what would be a circle circumference of the second end 106. The distance between the first flat surface 122 and the second flat surface 124 is greater than the first diameter $D_1$, but less than the second diameter $D_2$.

The second lifter 84 is substantially similar to the first lifter 54, thus the description of the first lifter 54 is equally applicable to the second lifter 84. As with the first lifter 54, the second lifter 84 includes a second lifter body 132 with a first end 134 having a second roller 136 and a second end 138 that includes a first flat surface 140 and a second flat surface 142 formed on the opposite side of the second end 138 from the first flat surface 140.

INDUSTRIAL APPLICABILITY

The engine 10 may be used in a variety of applications to provide power to, for example, construction equipment, generators, watercraft, vehicles, or other mobile or stationary machines. In the depicted embodiment, each cylinder of the engine includes two valve actuation assemblies 40, a first valve actuation assembly for actuating the intake valves for that cylinder and a second valve actuation assembly for actuating the exhaust valves for that cylinder. The first roller lifter 54 is associated with the first valve actuation assembly and the second roller lifter 84 is associated with the second valve actuation assembly.

The first lifter 54 is positioned in the first lifter bore 64 such that the first end 104 is received in the first lifter bore and the second end 106 is external to the first lifter bore. Likewise, the second lifter 84 is positioned in the second lifter bore 88, which is adjacent the first lifter bore 64, such that the first end 134 is received in the second lifter bore 88 and the second end 138 is external to the second lifter bore 88.

During engine operation, in response to rotation of the camshaft 60, the first lifter 54 reciprocates in the first lifter bore 64 and the second lifter 84 reciprocates in the second lifter bore 88 to open and close the engine valves for the cylinder. As a result of the rotation of the camshaft 60, the first and second lifters 54, 84 are prone to rotate about their respective longitudinal axes. The lifter bodies 100, 132, however, are configured to engage each other and prevent the first lifter 54 and the second lifter 84 from rotating. In particular, the first flat surface 122 on the second end 106 of the first lifter 54 engages the first flat surface 140 on the second end 138 of the second lifter 84 to prevent rotation.

The disclosed roller lifter configuration prevents undesired rotation of the lifters without the need for any additional devices, such as lifter guides, link bars, clips, etc. Instead, each lifter body includes integral structure, such as a flat surface, that engages corresponding structure on an adjacent lifter. Furthermore, each roller lifter may be configured substantially the same as the other roller lifters in the engine, thus avoiding multiple lifter designs for a single engine as is needed with some alignment device solutions.

What is claimed is:

1. An internal combustion engine, comprising:

an engine block comprising a first lifter bore and a second lifter bore, and a wall separating the first and second lifter bores;

a first roller lifter received in the first lifter bore; and a second roller lifter received in the second lifter bore;

the first roller lifter having a first surface, and the second roller lifter having a second surface in direct contact with the first surface, such that during operation of the engine the first roller lifter engages the second roller lifter by way of the contact to prevent axial rotation of the first roller lifter and the second roller lifter.

2. The internal combustion engine according to claim 1 wherein the first roller lifter includes a cylindrical first lifter body having a first end, a second end, and a recess extending along a longitudinal axis from the second end toward the first end, the first end having a first diameter, the second end having a second diameter greater than the first diameter.

3. The internal combustion engine according to claim 2 wherein the second end of the first lifter body engages the second roller lifter.

4. The internal combustion engine according to claim 2 wherein the second end is external to the first lifter bore.

5. The internal combustion engine according to claim 2 wherein the first surface comprises a first flat surface formed on a side of the second end.

6. The internal combustion engine according to claim 5 wherein the first roller lifter further comprises a second flat surface formed on an opposite side of the second end from the first flat surface, and wherein the distance between the first flat surface and the second flat surface is greater than the first diameter.

7. The internal combustion engine according to claim 5 wherein the first flat surface on the second end engages the second roller lifter.

8. The internal combustion engine according to claim 6 wherein the second surface comprises a corresponding flat surface on the second roller lifter, and the first flat surface on the second end of the first roller lifter engages the corresponding flat surface.

9. The internal combustion engine according to claim 6 wherein the second roller lifter includes a cylindrical second lifter body having a first end, a second end, the first end having a first diameter, the second end having a second diameter greater than the first diameter.

10. The internal combustion engine according to claim 8 wherein the corresponding flat surface is formed on a side of a second end of the second roller lifter, and wherein the corresponding flat surface engages the first flat surface of the first roller lifter.

* * * * *